US006892797B2

(12) United States Patent
Beddome et al.

(10) Patent No.: US 6,892,797 B2
(45) Date of Patent: May 17, 2005

(54) HEAT EXCHANGER WITH BIASED AND EXPANDABLE CORE SUPPORT STRUCTURE

(75) Inventors: David W. Beddome, San Pedro, CA (US); Steven M. Ayres, Redondo Beach, CA (US); Edward Yuhung Yeh, Ranchos Palos Verdes, CA (US)

(73) Assignee: Honeywell International, Inc., Morristown, NJ (US)

( * ) Notice: Subject to any disclaimer, the term of this patent is extended or adjusted under 35 U.S.C. 154(b) by 211 days.

(21) Appl. No.: 10/037,564

(22) Filed: Dec. 21, 2001

(65) Prior Publication Data

US 2003/0116305 A1 Jun. 26, 2003

(51) Int. Cl.[7] ..... F28F 7/00

(52) U.S. Cl. ..... 165/81; 165/82; 165/145; 165/157

(58) Field of Search ..... 165/81, 82, 165, 165/166, 67, 145, 157, DIG. 51, DIG. 60; 285/226, 229

(56) References Cited

U.S. PATENT DOCUMENTS

| | | | | | |
|---|---|---|---|---|---|
| 1,134,324 | A | * | 4/1915 | Fisher | 165/83 |
| 1,780,477 | A | * | 11/1930 | Grace | 165/83 |
| 3,893,505 | A | * | 7/1975 | Fujikake et al. | 165/9 |
| 3,910,542 | A | | 10/1975 | Bridgnell et al. | |
| 3,957,107 | A | * | 5/1976 | Altoz et al. | 165/276 |
| 4,047,740 | A | * | 9/1977 | Young et al. | 285/47 |
| 4,134,306 | A | * | 1/1979 | Grotness et al. | 74/29 |
| 4,134,449 | A | * | 1/1979 | La Haye et al. | 165/83 |
| 4,152,399 | A | * | 5/1979 | Germerdonk et al. | 423/210 |
| 4,582,126 | A | * | 4/1986 | Corey | 165/82 |
| 4,697,633 | A | * | 10/1987 | Darragh et al. | 165/51 |
| 5,333,681 | A | | 8/1994 | Jullien et al. | |
| 5,385,203 | A | * | 1/1995 | Mitsuhashi et al. | 165/110 |
| 6,119,766 | A | * | 9/2000 | Blomgren | 165/81 |
| 6,703,154 | B2 | * | 3/2004 | Gorbell et al. | 429/32 |

FOREIGN PATENT DOCUMENTS

| | | | | |
|---|---|---|---|---|
| EP | 0043113 A2 | | 6/1982 | |
| JP | 08029077 A | * | 2/1996 | F28D/9/00 |
| JP | 11294737 A | * | 10/1999 | F23G/5/48 |
| WO | WO 96/19708 A1 | | 6/1996 | |

OTHER PUBLICATIONS

U.S. Appl. No. 09/652,949, filed Aug. 31, 2000, Yeh et al.
U.S. Appl. No. 09/864,581, filed May 24, 2001, Beddome et al.

* cited by examiner

*Primary Examiner*—Tho V Duong
(74) *Attorney, Agent, or Firm*—Chris James; Ephraim Starr

(57) ABSTRACT

A heat exchanger, including a core having a variable size or length and a support structure connected to the core, the support structure accommodating variations in the size of the core.

3 Claims, 14 Drawing Sheets

HEAT EXCHANGER WITH BIASED AND EXPANDABLE CORE SUPPORT STRUCTURE

BACKGROUND OF THE INVENTION

To improve the overall efficiency of a gas turbine engine, a heat exchanger or recuperator can be used to provide heated air for the turbine intake. The heat exchanger operates to transfer heat from the hot exhaust of the turbine engine to the compressed air being drawn into the turbine. As such, the turbine saves fuel it would otherwise expend raising the temperature of the intake air to the combustion temperature.

The heat of the exhaust is transferred by ducting the hot exhaust gases past the cooler intake air. Typically, the exhaust gas and the intake air ducting share multiple common walls, or other strictures, which allow the heat to transfer between the two gases (or fluids depending on the specific application). That is, as the exhaust gases pass through the ducts, they heat the common walls, which in turn heat the intake air passing on the other side of the walls. Generally, the greater the surface areas of the common walls, the more heat which will transfer between the exhaust and the intake air. Also, the more heat which transfers between the exhaust and the air, the greater the efficiency of the heat exchanger will be.

As shown in the cross-sectional view of FIG. 1, one example of this type of device is a heat exchanger 5, which uses a shell 10 to contain and direct the exhaust gases, and a core 20, placed within the shell 10, to contain and direct the intake air. As can be seen, the core 20 is constructed of a stack of thin plates 22 which alternatively channel the inlet air and the exhaust gases through the core 20. That is, the layers 24 of the core 20 alternate between channeling the inlet air and channeling the exhaust gases. In so doing, the ducting keeps the air and exhaust gases from mixing with one another. Generally, to maximize the total heat transfer surface area of the core 20, many closely spaced plates 22 are used to define a multitude of layers 24. Further, each plate 22 is very thin and made of a material with good mechanical heat conducting properties. Keeping the plates 22 thin assists in the heat transfer between the hot exhaust gases and the colder inlet air.

Typically, during construction of such a heat exchanger 5, the plates 22 are positioned on top of one another and then compressed to form a stack 26. Since the plates 22 are each separate elements, the compression of the plates 22 ensures that there are always positive compressive forces on the core 20, so that the plates 22 do not separate. The separation of one or more plates 22 can lead to a performance reduction or a failure by an outward buckling of the stack 26. As such, typically the heat exchanger 5 is constructed such that the stack 26 is under a compressive pre-load.

Applying a high pre-load reduces the potential for separation of the plates 22. However, this approach does have the significant drawback that all the components of the core 20 are placed under much greater stress than they would be without the pre-loading. In addition, the pre-loading requires that the structure supporting the stack 26 must be much stronger and thus thicker. This pre-load assembly or support structure 40 collectively includes strongbacks 28, tie rods 30, as well as the shell 10 structure. This support structure 40 adds to both the weight and the cost of the heat exchanger 5.

Because the support structure 40 supports the core 20 and is not a heat transfer medium, the components of the support structure 40 are typically made of much thicker materials than that of the core 20. Unfortunately, these thicker materials cause the support structure 40 to thermally expand at a much slower rate than the quick responding core 20, which has the thin plates 22. The thickness (and thus the thermal response) of the support structure 40 will also be affected by the amount of the pre-load it must apply to the core 20.

Differential thermal expansion between elements of the heat exchanger 5 will cause a compression load to be applied to the quicker expanding sections (e.g. the core 20 and specifically the stack 26). As noted, a compression load is also applied to the stack 26 by the application of a pre-load. Compressive forces from pre-loading and differential thermal expansion can cause a variety of problems, such as buckling, fatigue failures and creep. Buckling is particularly problematic as it results in the stack 26 expanding outward (laterally) in one or more directions. This outward expansion causes the plates 22 to separate from one another, resulting in a nearly complete destruction of the heat exchanger. Fatigue and creep frequently occur when heat exchangers are repeatedly cycled between hot and cold stages. Depending on the particular application, a turbine (not shown) attached to a heat exchanger can be started, ran for a short period of time and then shutdown, over and over. One example of such cyclic use is a turbine and heat exchanger apparatus employed in the production of electric power. Typically, such devices are run only during recurring periods of peak power demand.

An additional source of loading on the heat exchanger can be from the airflow in the core 20. When the inlet air in the core 20 is pressurized, the core 20 will want to expand out against the support structure 40. This increases the amount of support structure needed to contain the core 20, which further reduces the thermal response of the supporting structure 40.

Prior approaches to providing for differential expansion between the core 20 and the shell 10, have included providing a gap or space for the core to expand into. However, the use of such a gap greatly reduces the efficiency of the heat exchanger by allowing much of the exhaust gas to pass around the core and not through it. Because of the gas pressures typically involved, even a very small gap can allow a great deal of exhaust gas to bypass the core. When the exhaust gas bypasses the core, less heat transfers to the intake air, and as a result, the overall efficiency of the heat exchanger (and thus of the turbine) drops dramatically.

Therefore, a need exists for a heat exchanger which allows for differential thermal expansion between the core and the supporting structure, thereby preventing core buckling, fatigue failures, creep or other similar problems. The heat exchanger must however apply, throughout the differential expansion, a force (e.g. pre-load) to the core, which is sufficient to keep the core plates from separating or otherwise deviating from their positions. In addition, the heat exchanger must maintain a seal between the core and the shell, so to prevent the gases from bypassing the core, which would otherwise reduce the efficiency of the heat exchanger. Further, such an apparatus should be relatively simple in construction and operation to minimize its cost, weight and complexity.

SUMMARY OF THE INVENTION

In some embodiments, the present invention is a heat exchanger which includes a core having a variable size and a support structure connected to the core. The support structure has a deformable member for accommodating variations in the size of the core. The support structure also includes a biasing member for applying a biasing force to the core. In some embodiments, the deformable member and the biasing member share the same structure. The deformable member and/or the biasing member can include a tension spring, a compression spring, a bellows, or a piston assembly.

In other embodiments the Applicant's invention is a heat exchanger which includes a core having a variable length and a support structure which receives the core. The support structure includes a fixed member and an attached biased deformable member. The biased deformable member accommodates variations in the length of the core while applying a biasing force to the core. The biased deformable member can include a tension spring, a compression spring, a bellows, or a piston assembly. The fixed member can include a first portion and a second portion which are positioned about and are in contact with the core with the biased deformable member being mounted between the first portion and the second portion.

The biased deformable member can be a tie rod having a coiled spring section. The spring section allows the tie rod to deform to accommodate variations in the length of the core, while applying a biasing force to the first and second portions of the fixed member. In place of a coiled spring, the tie rod can have a shaped spring section, such as an 's-shape'. In other embodiments, the deformable member is a tie rod with a compression spring placed between the end of the tie rod and a portion of the fixed member. Examples of compression springs include a coiled spring or a Belleville washer.

In other embodiments, the fixed member comprises a first end and a second end positioned about the core. The first end is in contact with the core and the biased deformable member is mounted between the core and the second end of the fixed member. The biased deformable member is positioned so that it can be deformed as the length of the core varies. In these embodiments the biased deformable member can be a compression spring (e.g. coil spring), a bellows or a piston assembly. The bellows includes a first plate, a second plate and an expandable sidewall mounted between the first plate and the second plate. The bellows can be narrower, the same width or wider than the core. The piston assembly includes a cylinder and a piston received by the cylinder. As with the bellows, the piston assembly can be narrower, the same width or wider than the core.

DETAILED DESCRIPTION OF THE INVENTION

Figure 1:
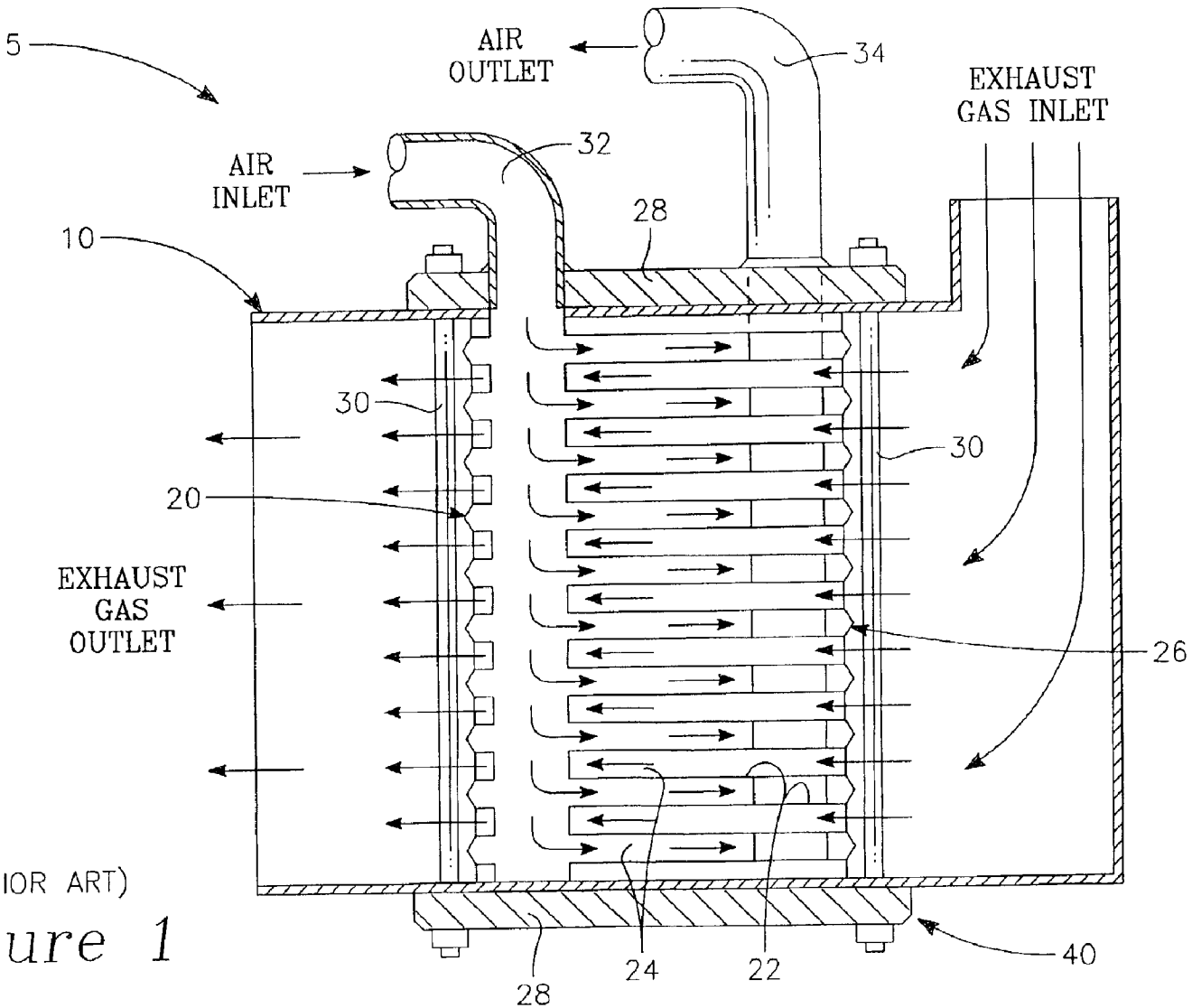
(PRIOR ART) Figure 1
FIG. 1 is a side cut-away view of a portion of a heat exchanger.

The present invention allows differential thermal expansion to occur between the heat exchanger's core and the support structure, without damage resulting from buckling, fatigue failure, creep or any other similar cause. The Applicants' invention provides for this differential expansion with a mechanically expandable support structure, which expands and contracts with the core, while applying a continuous biasing force to the core. The support structure uses a biased deformable member, which allows the support structure to accommodate variations in the core size. As described in detail herein, the present invention has several advantages over the prior art.

Unlike prior devices, the Applicants' invention allows for the differential thermal expansion of the core by allowing the support structure to expand not only thermally but also mechanically. Also, in at least some embodiments, the present invention employs a biasing means to maintain a compression force on the core. As such, an advantage is achieved with the present invention of allowing the core to thermally expand relatively freely while the core is kept under a compressive force (e.g. pre-load) to prevent the core from separating or otherwise displacing in an undesired manner.

Another advantage of some embodiments of the Applicants' invention is that the heat exchanger allows the core to thermally expand freely while maintaining contact between the core and the shell. This continuous core-to-shell contact prevents gaps from forming between the two structures, thus keeping exhaust gases from bypassing around the core. As a result, the efficiency of the heat exchanger is maximized by forcing the hot gases through the core, so that the maximum amount of heat can be transferred from the exhaust gases to the cooler intake air.

Still another advantage of embodiments of the present invention is that by allowing the core to expand and contract relatively freely, the core is not placed under additional compressive loads caused by restraining the core's movement. As such, the problems of buckling, fatigue failure and creep typically associated with prior heat exchangers are avoided. Further since the core is not under these additional compressive loads, the pre-load placed on the core can be dramatically reduced. In at least some embodiments of the present invention, by carrying substantially less loads the shell requires less structure and can therefore thermally expand and contract much quicker. This also allows the shell to be simpler, lighter and less expensive to manufacture.

Therefore, the present invention provides a heat exchanger, or similar apparatus, which reduces the potential for damage to the core (e.g. plate separation, buckling, fatigue failure, creep, etc.), which is more efficient, easier to manufacture, lighter, and less expensive.

Heat exchanger apparatuses which provide for differential thermal expansion are set forth in U.S. patent application Ser. No. 09/652,949, filed oil Aug. 31, 2000, entitled HEAT EXCHANGER WITH BYPASS SEAL ALLOWING DIFFERENTIAL THERMAL EXPANSION, by Yuhung Edward Yeh, Steve Ayres and David Beddome, which is hereby incorporated by reference in its entirety, and U.S. patent application Ser. No. 09/864,581, filed on May 24, 2001, entitled HEAT EXCHANGER WITH MANIFOLD TUBES FOR STIFFENING AND LOAD BEARING, by David W. Beddome, Steve Ayres, Yuhung Edward Yeh, Ahmed Hammond, David Bridgnell and Brian Comiskey, which is hereby incorporated by reference in its entirety.

Figure 2:
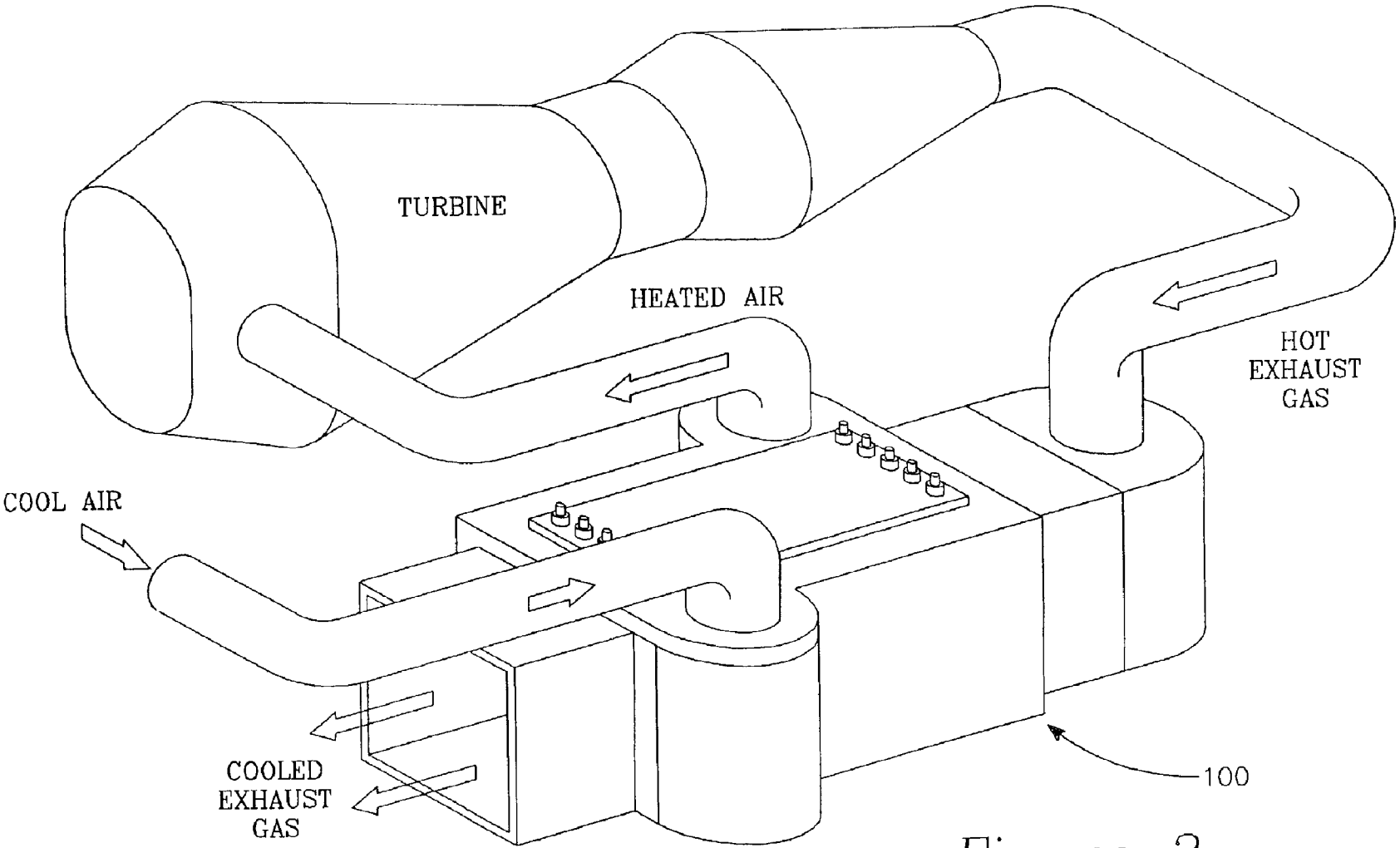
FIG. 2 is an isometric view of a turbine/heat exchanger system.

As shown in FIG. 2, for some embodiments, the present invention is a heat exchanger 100 which can be used in conjunction with a gas turbine engine. The heat exchanger 100 functions to heat the inlet air prior to it entering the turbine and cool the turbine exhaust gases prior to exiting the heat exchanger 100. This is achieved by directing the inlet air so that it passes adjacent to the exhaust gas, such that heat is transferred from the exhaust to the inlet air. Specifically, as set forth in FIG. 2, air enters at an air inlet and is directed through the heat exchanger 100 where it is heated by heat from the exhaust gases. Then, the heated air is directed from the heat exchanger 100 to the turbine. The turbine uses the air to operate and in so doing expels exhaust gas. The exhaust gas is directed into and through the heat exchanger 100 where it heats the inlet air. The cooled exhaust gas then exits from the heat exchanger 100. A detailed description of the functioning and structure of the heat exchanger 100 is set forth herein. While FIG. 2 shows an example of a system that at least some embodiments of the present invention can be used, many other systems and uses are possible, including the use of engines other than a gas turbine.

Figure 3:
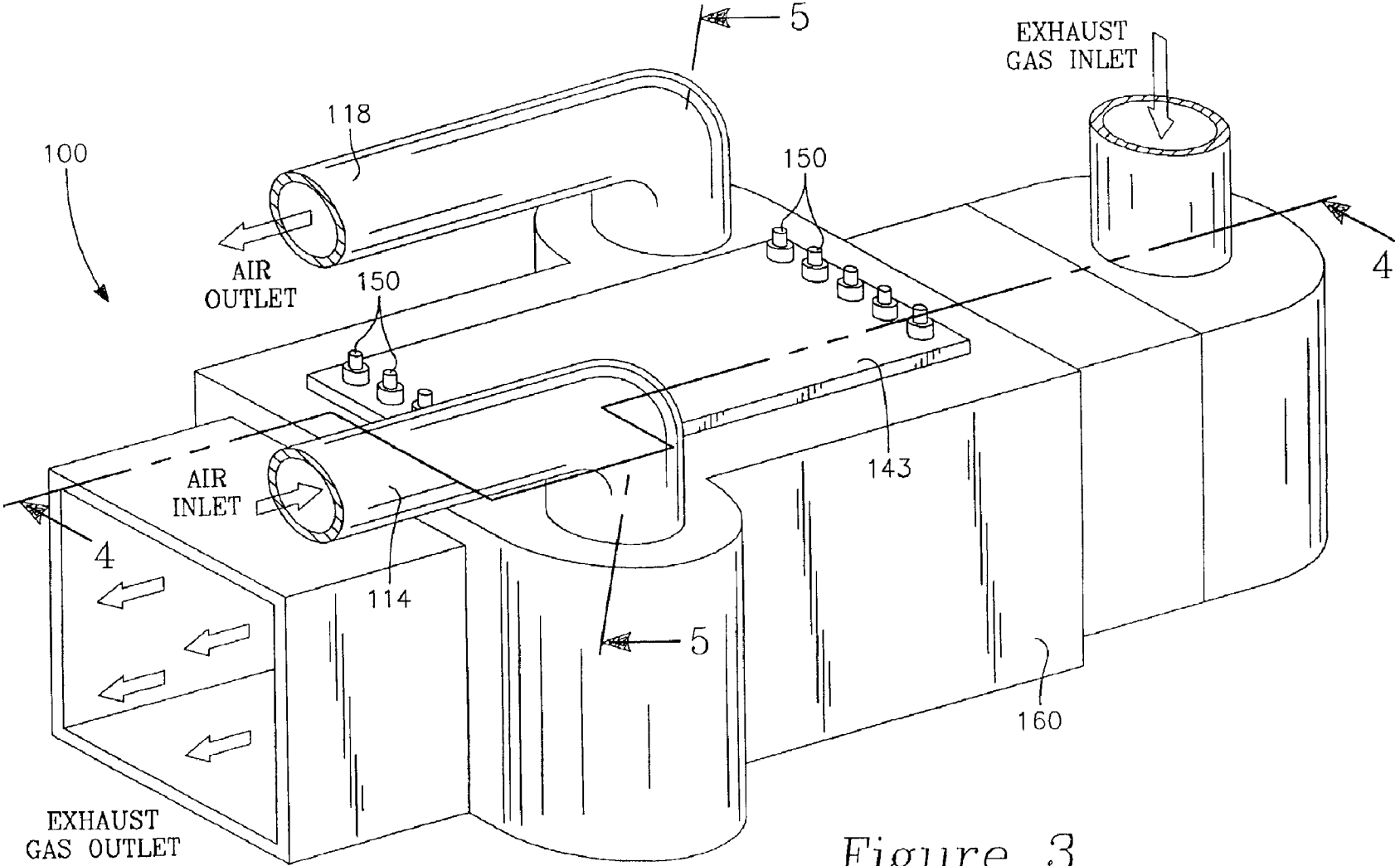
FIG. 3 is an isometric view of a heat exchanger in accordance with the present invention

FIG. 3 shows an embodiment of the heat exchanger 100 with an air inlet 114 and an air outlet 118 to bring air into and out of a heat transfer core (not shown), and an exhaust gas inlet and an exhaust gas outlet to direct the exhaust gases through the heat exchanger 100. The heat exchanger 100 also has a shell assembly 160 with an upper strongback 143 and a lower strongback 145 (not shown) on either end. Connecting the strongbacks is a set of tie rods 150. FIG. 3 also sets forth the cross-sections of the heat exchanger 100 as shown in FIGS. 4 and 5.

Figure 4:
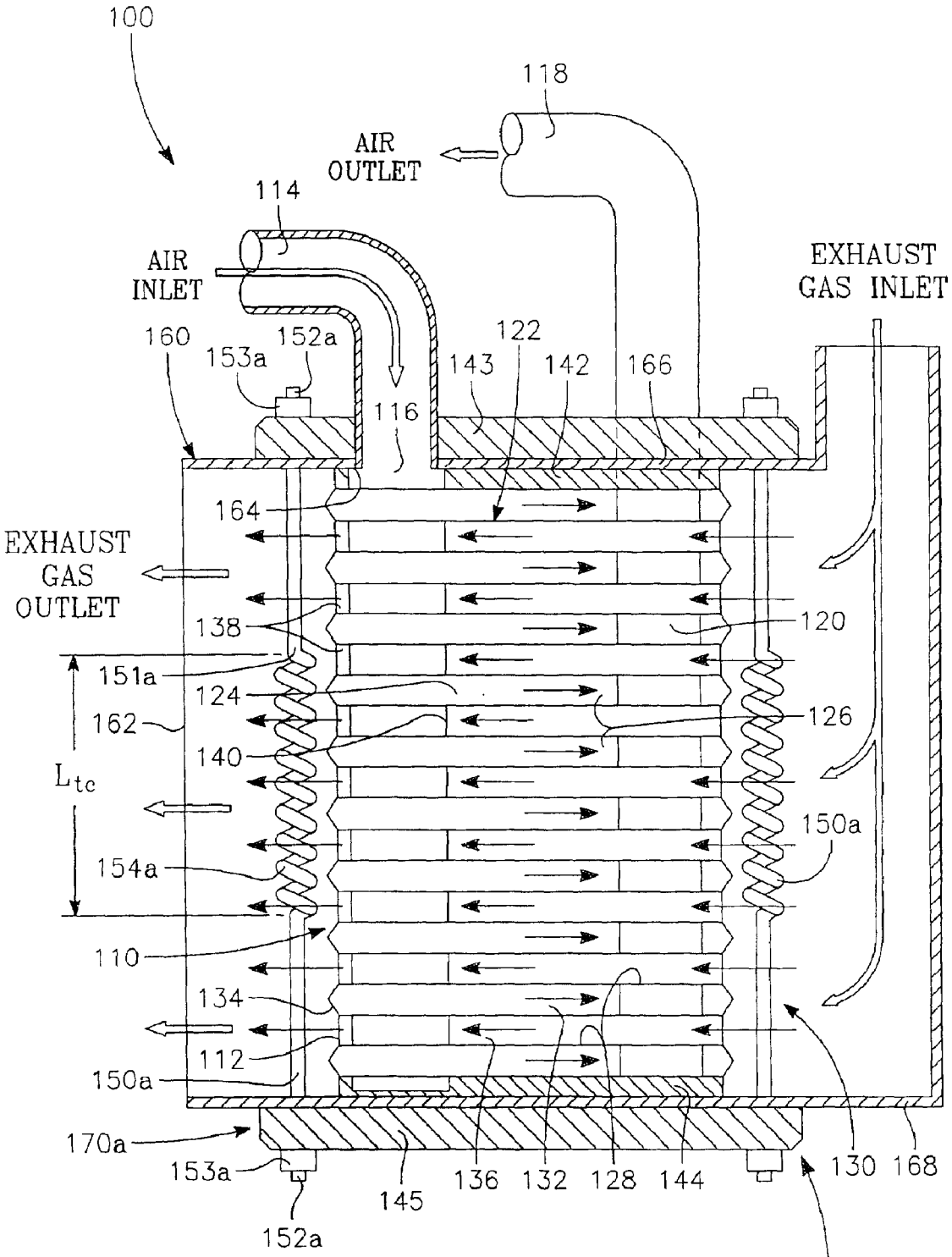
FIG. 4 is a side cut-away view of a portion of a heat exchanger in accordance with the present invention.
Figure 5:
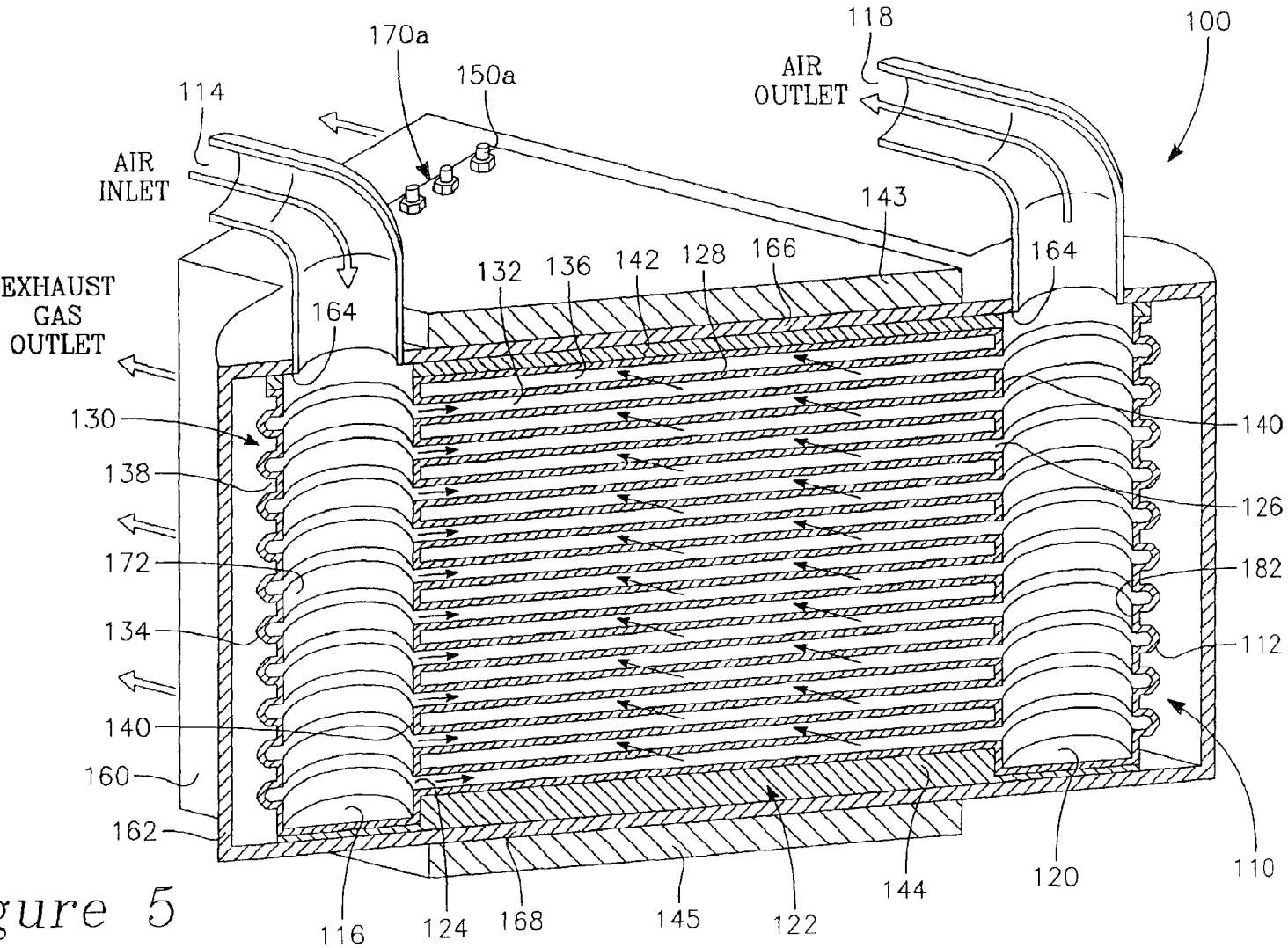
FIG. 5 is an angled side cut-away view of a portion of a heat exchanger in accordance with the present invention.

For some embodiments of the present invention, as shown in the cut-away views of FIGS. 4 and 5, the heat exchanger 100, has a core 110 positioned within the shell assembly 160. Outside the shell 160 are the upper strongback 143 and the lower strongback 145 connected by the tie rods 150.

The core 110 is positioned within the shell 160. The core 110 functions to duct the inlet air pass the exhaust gas, so that the heat of the exhaust gas can be transferred to the cooler inlet air. The core 110 performs this function while keeping the inlet air separated from the exhaust gas, such that there is no mixing of the air and the gas. By moving air near the gas without mixing the two, the heat exchanger 100 transfers heat at a high level of efficiency. Further, the heat exchanger 100 also maximizes engine performance by not allowing the exhaust gases to be introduced into the intake air of the turbine (or other engine).

As shown in FIGS. 4 and 5, the core 110 has an exterior surface 112. An air inlet 114 and an air outlet 118 to bring air into and out of the core 110. The air inlet 114 receives relatively cool inlet air for passage through the core 110. When the heat exchanger 100 is operating, the air exiting the air outlet 118, having been heated in the core 110, will have a much higher temperature than the inlet air. Between the air inlet 114 and the air outlet 118 are the inlet manifold 116, a heat exchange region 122 and the outlet manifold 120.

While the heat exchanger 100 is operating the core 110 has a variable size (e.g. length) caused by thermal expansion or contraction. That is, as the core 110 is heated up by the exhaust gases passing through the shell, the core 110 will expand and as the heat exchanger 100 stops operating the core 110 will contract as it cools.

The heat exchange region 122 can be any of a variety of configurations that allow heat to transfer from the exhaust gas to the inlet air, while keeping the gases separate. However, it is preferred that the heat exchange region 122 be a prime surface heat exchanger having a series of layered plates 128, which form a stack 130. The plates 128 are arranged to define heat exchange members or layers 132 and 136 which alternate from ducting air, in the air layers 132, to ducting exhaust gases, in the exhaust layers 136. These layers typically alternate in the core 110 (e.g. air layer 132, gas layer 136, air layer 132, as layer 136, etc.). Separating each layer 132 and 136 is a plate 128.

On either end of the stack 130 are a first end plate 142 and a second end plate 144. The first end plate 142 is positioned against the upper portion of the shell assembly 160 and the second end plate 144 is positioned against the lower portion of the shell assembly 160.

Also shown in FIG. 4, are biased deformable members or tie rods 150*a*. A series of tie rods 150*a* and an upper strongback or load bearing member 143 and a lower strongback or load-bearing member 145, are used to hold the stack 130 together and carry loads. The tie rods 150*a* function to apply a compressive load to the strongbacks 143 and 145. The tie rods 150*a* include a bar section 151*a* running between either end 152*a* and fasteners 153*a* at each end 152*a*. The fasteners 153*a* function to hold the tie rods 150*a* to the strongbacks 143 and 145.

On the outside of the shell 160 and above and below the core 110, are the upper strongback 143 and the lower strongback 145. The tie rods 150*a* and the strongbacks 143 and 145 (as well as the shell 160) carry compressive loads applied to the stack 130. These compressive loads can be from a variety of sources including pre-loading, differential thermal expansion, air pressure, and the like. The upper strongback 143, the lower strongback 145, the tie rods 150*a*, as well as the shell 160, collectively form a support structure 170*a* which functions to apply the compressive force to the stack 130 of the core 110. In contrast to the tie rods 150*a*, the upper strongback 143 and the lower strongback 145 (collectively a fixed member, with the upper strongback 143 a first portion of the fixed member and the lower strongback 145 a second portion of the fixed member) are generally not deformable.

As can be seen, the plates 128 are generally aligned with the flow of the exhaust gas through the shell assembly 160. The plates 128 can be made of any well-known suitable material, such as steel, stainless steel or aluminum, with the specific material dependent on the operating temperatures and conditions of the particular use. The plates 128 are stacked and connected (e.g. welded or brazed) together in an arrangement such that the air layers 132 are closed at their ends 134. With the air layers 132 closed at ends 134, the core 110 retains the air as it passes through the core 110. The air layers 132 are, however, open at air layer intakes 124 and air layer outputs 126. As shown in FIGS. 4 and 5, the air layer intakes 124 are in communication with the inlet manifold 116, so that air can flow from the air inlet 114 through the inlet manifold 116 and into each air layer 132. Likewise, the air layer outputs 126 are in communication with the outlet manifold 120, to allow heated air to flow from the air layers 132 through the outlet manifold 120 and out the outlet 118.

In contrast to the air layers 132, the gas layers 136 of the stack 130 are open on each end 138 to allow exhaust gases to flow through the core 110. Further, the gas layers 136 have closed or sealed regions 140 located where the layers 136 meet both the inlet manifold 116 and the outlet manifold 120. These closed regions 140 prevent air, from either the inlet manifold 116 or the outlet manifold 120, from leaking out of the core 110 into the gas layers 136. Also, the closed regions keep the exhaust gases from mixing, with the air.

Therefore, as shown in FIGS. 4 and 5, the intake air is preferably brought into the core 110 via the inlet manifold 116 and distributed along the stack 130, passed through the series of air layer intakes 124 into the air layers 132, then sent through the air layers 132 (such that the air flows adjacent—separated by plates 128—to the flow of the exhaust gas in the gas layers 136), exited out of the air layer 132 at the air layer outputs 126 into the outlet manifold 120, and finally out of the core 110. In so doing, as the air passes through the core 110 it receives heat from the exhaust gas.

With the stack 130 arranged as shown in FIGS. 4 and 5, the hot exhaust gas passes through the core 110 at each of the gas layers 136. The exhaust gas heats the plates 128 positioned at the top and bottom of each gas layer 136. The heated plates 128 then, on their opposite sides, heat the air passing through the air layers 132.

As the plates 128 and the connected structure of the core 110 heat up, they expand. This results in an expansion of the entire stack 130 and thus of the core 110. As noted, this expansion is typically faster than the thermal expansion of the supporting structure 170*a* (the shell 160, strongbacks 143 and 145 and the tie rods 150*a*). The resulting differential expansion causes the core 110 to apply a force against the restraining support structure 170*a*. As noted in detail below, the support structure 170*a* is biased and functions to mechanically expand with the thermal expansion of the core 110. In this manner, support structure 170*a* allows the core 110 to thermally expand quicker, with minimal build-up of additional forces between the core 110 and the structure 170*a*. This prevents the core 110 from being damaged by excess compressive forces which would otherwise be created if the support structure could not expand to accommodate the differential thermal expansion. In addition, in at least some embodiments, the support structure 170*a* continuously applies to the core 110 a compressive force which is at least sufficient to keep the plates 128 of the core 110 from being displaced.

Although the core 110 can be arranged to allow the air to flow through it in any of a variety of ways, it is preferred that the air is channeled so that it generally flows in a direction opposite, or counter, to that of the flow of the exhaust gas in the gas layers 136 (as shown in the cross-section of FIG. 4). With the air flowing in an opposite direction to the direction of the flow of the exhaust gas, it has been found by the Applicants that the efficiency of the heat exchanger is significantly increased as compared to other flow configurations.

The arrangement of the core 110 can be any of a variety of alternative configurations. For example, the air layers 132 and gas layers 136 do not have to be in alternating layers, instead they can be in any arrangement which allows for the exchange of heat between the two layers. For example, the air layers 132 can be defined by a series of tubes or ducts running between the inlet manifold 116 and the outlet manifold 120. While the gas layers 136 are defined by the space outside of, or about, these tubes or ducts. Of course, the heating of such a configuration of the core most likely will still result in differential thermal expansion between the core and the support structure.

To facilitate heat transfer, the core 110 can also include secondary surfaces such as fins or thin plates connected to the inlet air side of the plates 128 and/or to the exhaust gas side of the plates 128.

The core 110 and shell 160 can carry various gases, other than, or in addition to, those mentioned above. Also, the core 100 and shell 160 can carry any of a variety of fluids.

As shown in FIGS. 4 and 5, the shell assembly includes side walls 162, openings 164, upper panel 166 and lower panel 168. The shell assembly 160 functions to receive the hot exhaust gases, channel them through the core 110, and eventually direct them out of the shell 160. The shell 160 is relatively air tight to prevent the exhaust gases from leaking out of the shell 160. The shell 160 is large enough to fully contain the core 110 and at least strong enough to withstand the pressure exerted on the shell 160 by the exhaust gas. Typically, the shell 160 is flexible and can be deformed to varying amounts depending on its specific construction.

The openings 164 of shell 160 are positioned through the upper panel 166. The shell assembly 160 can be made of any suitable well known material including, but not limited to, steel and aluminum. Preferably, the shell 160 is a stainless steel, when it is used in high temperature applications.

The construction of the shell assembly 160 can vary depending on the particular embodiment of the present invention. In some embodiments the shell 160 is constructed to carry some of the compressive load generated by the support structure 170*a* and applied to the core 110. The shell 160 can also be configured to carry other internally created loads (e.g. air pressure loads) and externally exerted loads (e.g. inertia loads or vibration loads). Because in some embodiments of the present invention, the walls 162, upper panel 166 and lower panel 168 of the shell 160 are thick relative to the thin core plates 128, the shell 160 will thermally expand at a slower rate than the core 110. This can result in differential thermal expansion or contraction between the shell 160 and the core 110, as the two are either heated or cooled, as the case may be. To avoid, or to minimize, gaps or spaces forming between the core 110 and the shell 160 during differential expansion, the shell 160 is flexible enough to be deformed by the forces applied by the strongbacks 143 and 145 and the tie rods 150*a*.

In other embodiments, the structure of the shell 160 is relatively thin. In such embodiments, the compressive loads created by the support structure 170*a* are primarily carried by the strongbacks 143 and 145 and the tie rods 150*a*. In such embodiments, because the shell 160 is thinner than in other embodiments, the shell 160, thermally expands and contracts much quicker. This allows any differential thermal expansion between the shell 160 and the core 110 to be minimized. Which, in turn, aids in preventing gaps from forming between the core 110 and the shell 160. This thinner structure also increases the shell's flexibility and allows the shell 160 to be more easily deformed by the strongbacks 143 and 145 and the tie rods 150*a*. As such, in these embodiments, the potential for exhaust gases being able to pass around the core 110, through gaps between the core 110 and the shell 160, is further reduced.

The present invention, however, provides for differential thermal expansion between the structures of the heat exchanger 100 by employing a mechanically expandable support structure. As shown herein, a variety of embodiments of the support structure 170*a* exist.

Coiled Tie Rod:

One embodiment of the support structure 170*a* is shown in FIG. 4. As can be seen, the tie rods 150*a* of this embodiment include a coiled bar section 151*a* running between the ends 152*a*. Fasteners 153*a* are attached to the bar section 151*a* at each end 152*a*, and function to hold the tie rod 150*a* against the strongbacks 143 and 145. The fasteners 153*a* are set at or near the ends 152*a* outboard of the strongbacks 143 and 145. In this manner, the tie rods 150*a* are held in tension between the strongbacks 143 and 145.

In this embodiment, the tie rods 150*a* have the bar section 151*a* shaped to include a spring portion 154*a*. A part of the bar section 151*a* of the tie rod 150*a* is shaped into a coil or spiral to form the spring portion 154*a*. With the tie rods 150*a* stretched in tension, the strongbacks 143 and 145 exert a compressive force to the elements of the heat exchanger 100 set in between them, including the core 110.

In this embodiment, the length $L_{tc}$ of the spring portion 154*a* is varied by the amount of the load placed on the tie rod 150*a*. For example, an increase in the load in tension on the tie rod 150*a* will expand the spring portion 154*a*, increasing the overall length $L_{tc}$ of the tie rod 150*a*. When deformed, the spring portion 154*a* applies a further biasing force in tension on the tie rod 150*a*. The amount the spring portion 154*a* is deformed is related to the force it exerts on other portions of the heat exchanger 100. In some embodiments a substantially linear relationship exists between the deformation of spring portion 154*a* and the force it exerts.

The specific configuration of the spring portion 154*a* can vary depending on the requirements of the use. Namely, the spring portion 154*a* is shaped and/or has material properties which allow the spring portion 154*a* to supply a biasing force on the core 110. The biasing force from the spring portion 154*a* is high enough to keep the core plates 128 together and in place, but low enough to allow the support structure 170*a* to mechanically expand in response to the differential thermal expansion of the core 110, without damage to the core 110. The specific configuration (e.g. size, coil shape, material, etc.) of the spring portion 154*a* for the particular application can be determined by one skilled in the design of such structures, using well known analytical and/or empirical methods.

As such, the tie rods 150*a*, as part of the support structure 170*a*, function both to permit the support structure 170*a* to apply a continuous force onto the core 110 and to allow the support structure 170*a* to mechanically expand. In this manner, the heat exchanger 100 (1) keeps a sufficient pre-load on the core 110 to prevent the plates 128 from separating or otherwise displacing from their original positions, (2) keeps the shell 160 and the core 110 in contact to avoid gaps between them, and (3) allows the support structure 170*a* to mechanically expand to accommodate the differential thermal expansion of the core 10, avoiding damage which could otherwise occur.

Instead of shaping the bar portion of the tie rod into a coil shape, an another embodiment of the tie rod has a straight bar portion attached to a separate tension spring. In this manner the separate tension spring can be placed anywhere along the tie rod between the strongbacks.

Figure 6:
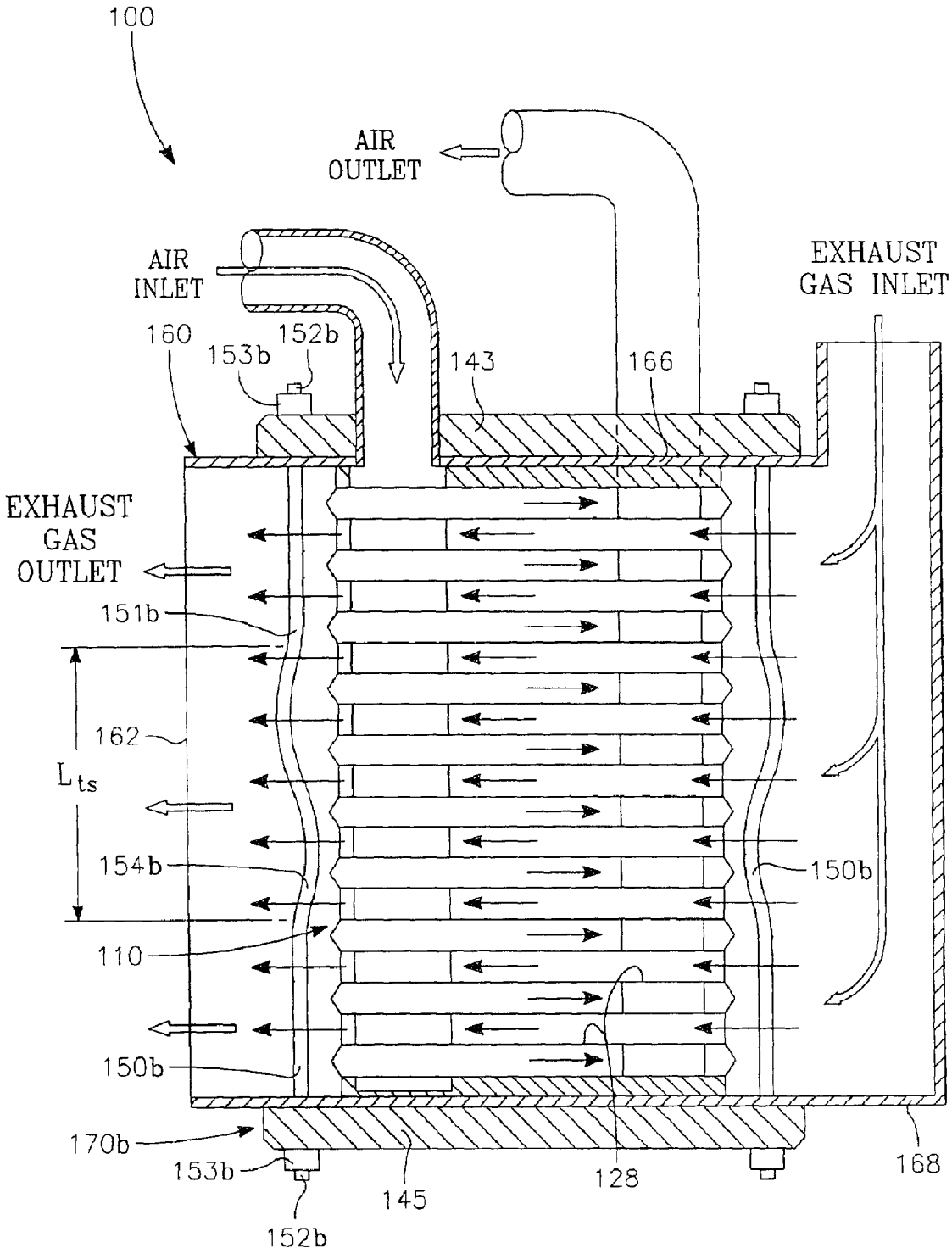
FIG. 6 is a side cut-away view of a portion of a heat exchanger in accordance with the present invention.

Shaped Tie Rod:

As shown in FIG. 6, in some embodiments of a support structure 170*b*, biased deformable members or shaped tie rods 150*b* are used. The shaped tie rods 150*b* function in a similar manner as the coiled tie rods 150*a* (not shown in FIG. 6), which are detailed above. That is, the tie rods 150*b* act as tension springs as their shape is deformed. As shown, the tie rods 150*b* are held in place at their ends 152*b* by fasteners 153*b*. Preferably, the tie rods 150*b* are held in tension, such that a biasing force is exerted. With the tie rods 150*b* acting as tension springs, the strong backs 143 and 145 are biased against the shell 160 and the core 110. In contrast to the tie rods 150*b*, the upper strongback 143 and the lower strongback 145 (collectively a fixed member, with the tipper strongback 143 a first portion of the fixed member and the lower strongback 145 a second portion of the fixed member) are generally not deformable. As such, the core 110 can be kept under a constant compressive force (pre-load) which retains the plates 128 in place. Since the bar section 151*b* of the tie rods 150*b* can be deformed along the length $L_{ts}$ of the shaped portion 154*b*, the support structure 170*b* can mechanically expand in response to the differential thermal expansion of the core 110.

FIG. 6 shows an embodiment of the tie rods 150*b* with the shaped portion 154*b* in an 'S-shape' or 'sine-wave' pattern. In this configuration the tie rods 150*b* can be deformed along the length $L_{ts}$ to allow the support structure 170*b* to mechanically expand. That is, as the core 110 differentially thermally expands against the support structure the tie rods 150*b* are pulled into a straighter shape. As the tie rods 150*b* are straightened out, they exert a further biasing force on the strongbacks 143 and 145. Likewise, as the core 110 thermally contracts quicker than the support structure 170*b*, the tie rods 150*b* will return to their original 'S-shapes', and in so doing they will mechanically contract the support structure 170*b* with the core 110.

In other embodiments, the tie rods 150*b* alternatively have any of a variety of other shapes which allow the tie rods 150*b* to be deformed along their lengths, such that they allow the support structure 170*b* to mechanical expand.

Figure 7A:
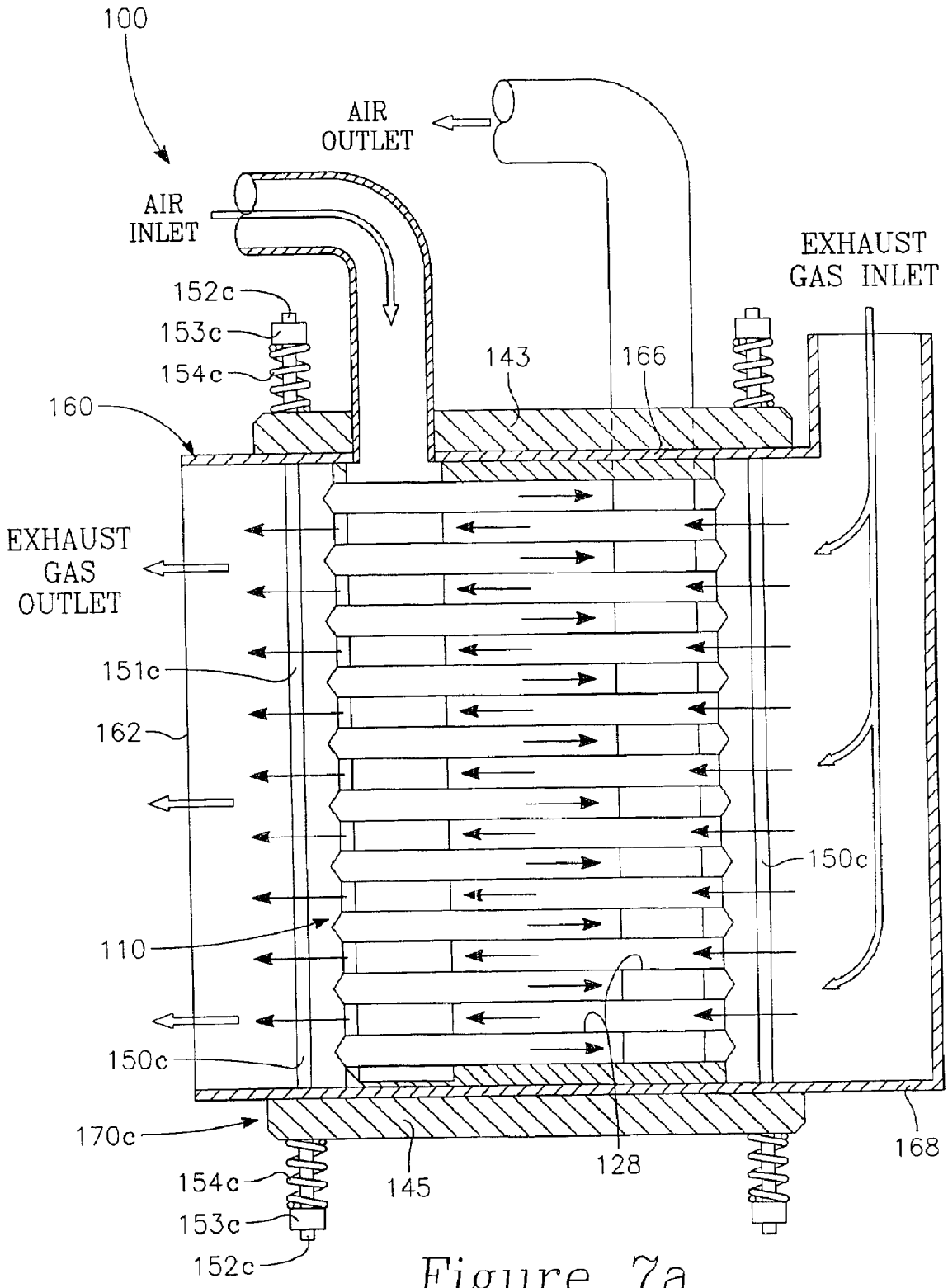
FIGS. 7*a* and *b* are side cut-away views of a portion of a heat exchanger in accordance with the present invention.

Tie Bar with Compression Spring:

In another embodiment of the present invention, a support structure 170*c*, as shown in FIG. 7*a*, employs biased deformable members or tie rods 150*c* which have springs positioned at their ends. Specifically, the tie rods 150*c* include a bar section 151*c* running between the ends 152*c*, fasteners 153*c* attached to the bar section 151*c* at each end 152*c*, and compression springs 154*c* positioned between the fasteners 153*c* and the strongbacks 143 and 145. The compression springs 154*c* are compressed between the fasteners 153*c* and the strongbacks 143 and 145. This results in a biasing force being applied by the compression springs 154*c* to the fasteners 153*c* and the strongbacks 143 and 145. This biasing force causes the strongbacks 143 and 145 to, in turn, apply a compressive force to the core 110. This compressive force allows the core 110 to be pre-loaded, preventing the plates 128 from separating or otherwise being displaced. In contrast to the tie rods 150*b*, the upper strongback 143 and the lower strongback 145 (collectively a fixed member, with the upper strongback 143 a first portion of the fixed member and the lower strongback 145 a second portion of the fixed member) are generally not deformable.

The compression springs 154*c* can further compress or alternatively expand to accommodate differential thermal expansion or contraction of the core 110. That is, as the temperature of the heat exchanger 100 changes and the core 110 either thermally expands or contracts faster than the support structure 170*c*, the compression springs 154*c* will allow the support structure 170*c* to mechanically expand so that the core 110 is not damaged. As such, the length of the springs 154*c* will change in response to the differential expansion or contraction of the core 110.

The specific configuration of the compression springs 154*c* and their force and displacement properties can vary depending on the requirements of the specific use in which they are employed. The necessary configuration and properties of the compressions springs 154*c* for the particular use can easily be determined by one skilled in the art of the design of such structures, using well known analytical and/or empirical methods.

Figure 7B:
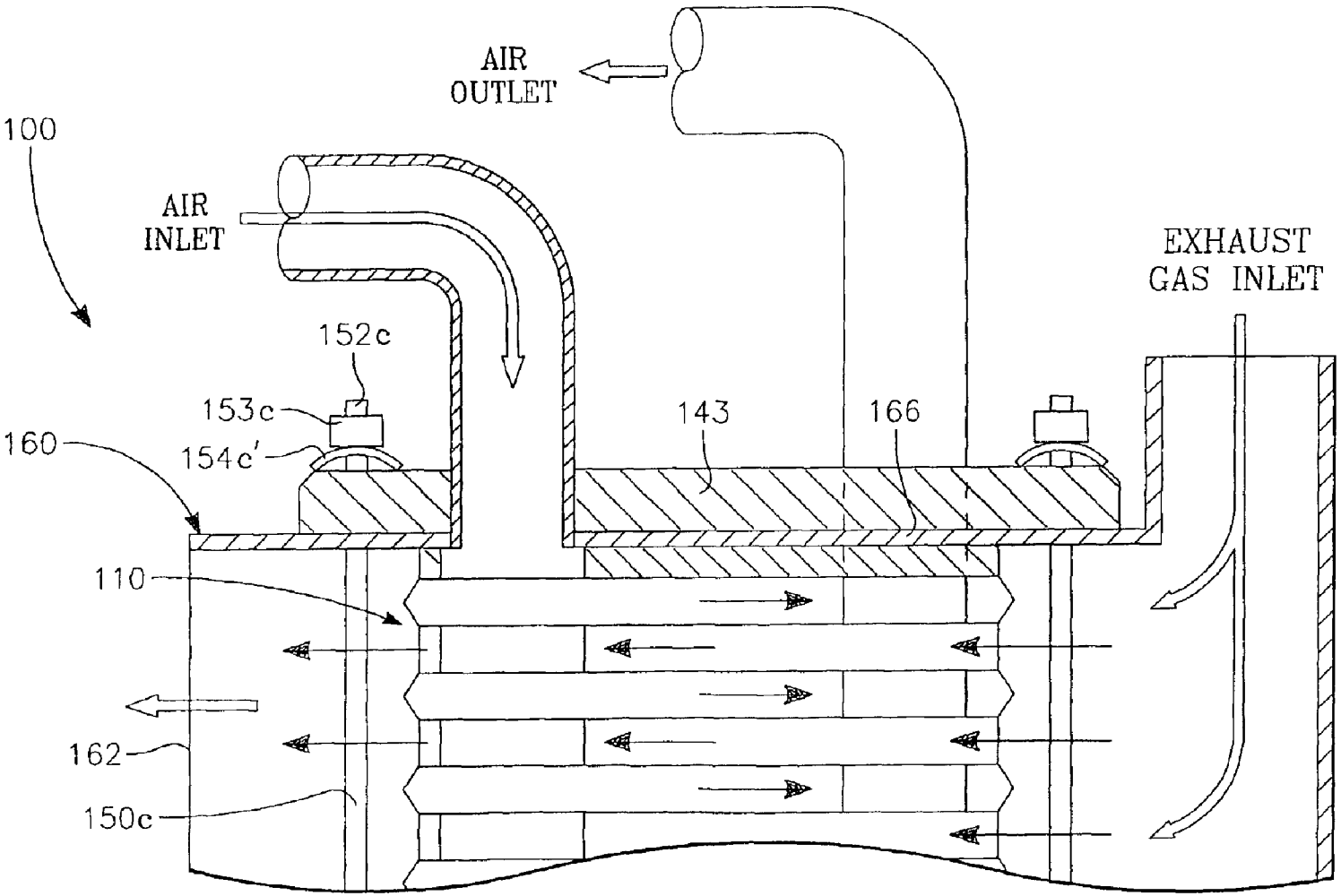

The compression springs 154*c* show in FIG. 7*a* are coil springs, however any of a variety of spring types can be used. For example, as shown in FIG. 7*b* a Belleville washer 154*c*' is used. The Belleville washer 154*c*' is curved so that it can deform to accommodate changes in the length of the core 110.

Figure 8A:
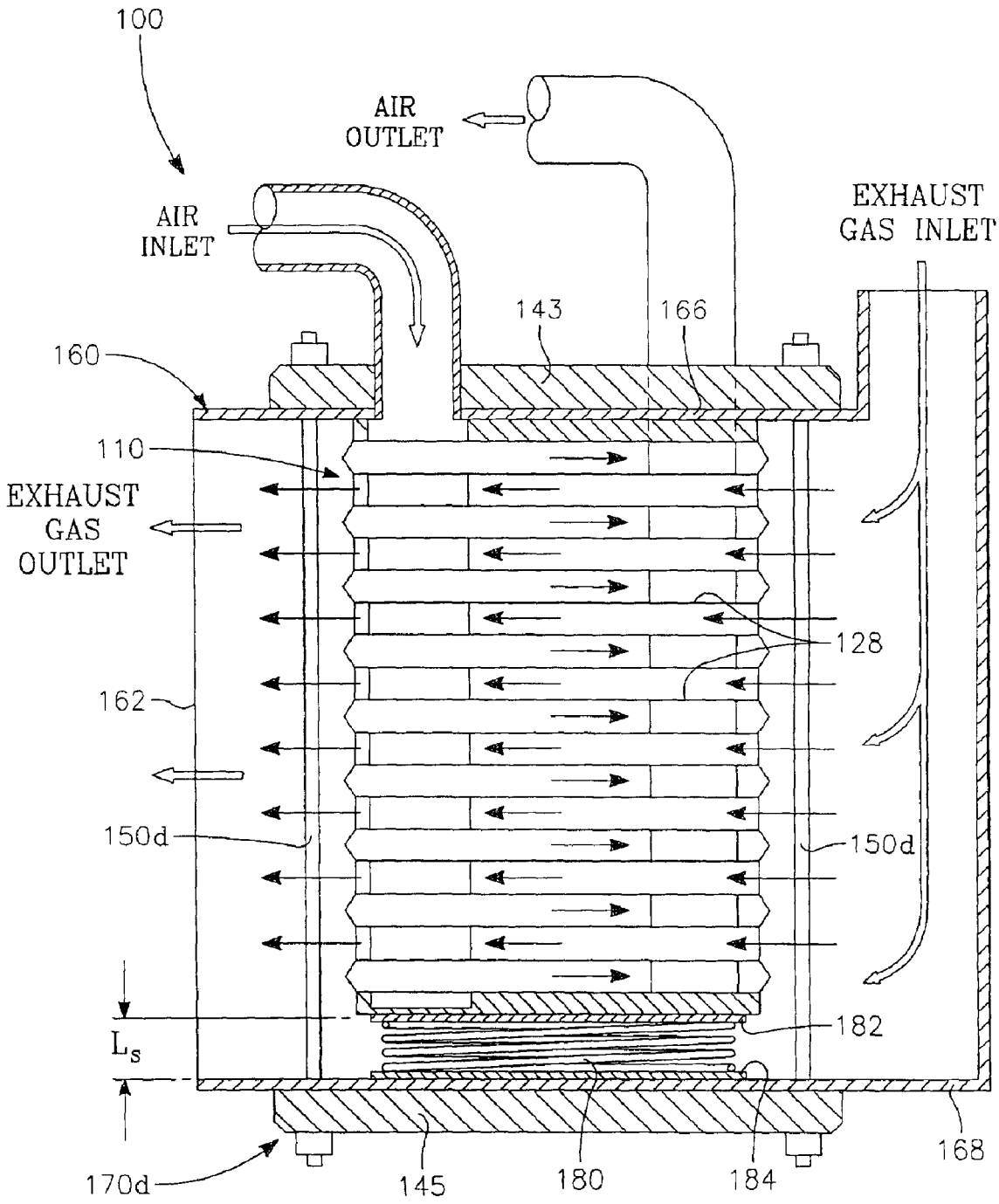
FIGS. 8*a* and *b* are side cut-away views of a portion of a heat exchanger in accordance with the present invention.

Compression Spring Apparatus:

In some embodiments of the present invention, in place of a support structure utilizing the deformable tie rods 150*a–c* (as described in detail above), one or more biased deformable members or compression springs 180 are used. One embodiment of the present invention employing a compression spring 180 is shown in FIG. 8*a*. Like the tie rods 150*a–c* (not shown FIG. 8*a*), the spring 180 allows a support structure 170*d*, which includes the strongbacks 143 and 145, tie rods 150*d* (the strong backs and ties rods collectively a fixed member with the strongback 143 at a first end and the strongback 145 at a second end of the fixed member), shell 160 and spring 180, to expand and contract with the core 110. The spring 180 also functions to apply a pre-load to the core 110. The compression spring 180 is part of the support structure 170*d*, and allows the support structure 170*d* to mechanically expand and contract, and to exert a biasing force.

In the embodiment shown, the spring 180 is positioned between the lower panel 168 of the shell 160 and the core 110. This allows the spring 180 to continuously apply a biasing force (pre-load) to the core 110. Also, this prevents the core plates 128 from separating or moving, which might cause the core 110 to buckle. That is, the loading exerted by the spring 180 keeps the plates 128 in their original positions so that the structure of the heat exchanger 100 is not damaged or otherwise compromised.

As the core 110 thermally expands or contracts independently from the support structure 170*d*, the structure 170*d* will mechanically expand due to the compression or expansion of the spring 180. That is, the spring 180 compresses as the core 110 expands, and it lengthens as the core 110 contracts. The overall length $L_s$ of the spring 180 changes as the core differently expands and contracts. In the embodiment shown, the spring 180 is coil spring and includes a first mounting surface 182 and a second mounting surface 184. The first surface 182 abuts the core 110 and the second surface 184 is in contact with the shell 160.

Depending on the amount of compressive force (preloading) that must be applied to the core 110, the spring 180 can be compressed different amounts prior to being placed between the core 110 and the shell 160.

The specific aspects of the spring 180 (e.g. size, shape, spring constant, material used etc.) can vary depending on the requirements of the specific use. One skilled in the art of the design of such apparatuses can determine the specific characteristics of the spring 180 by well known analytical and/or empirical methods. While any of a variety of materials can be used, it is preferred that the spring 180 be constructed of a stainless steel.

Figure 8B:
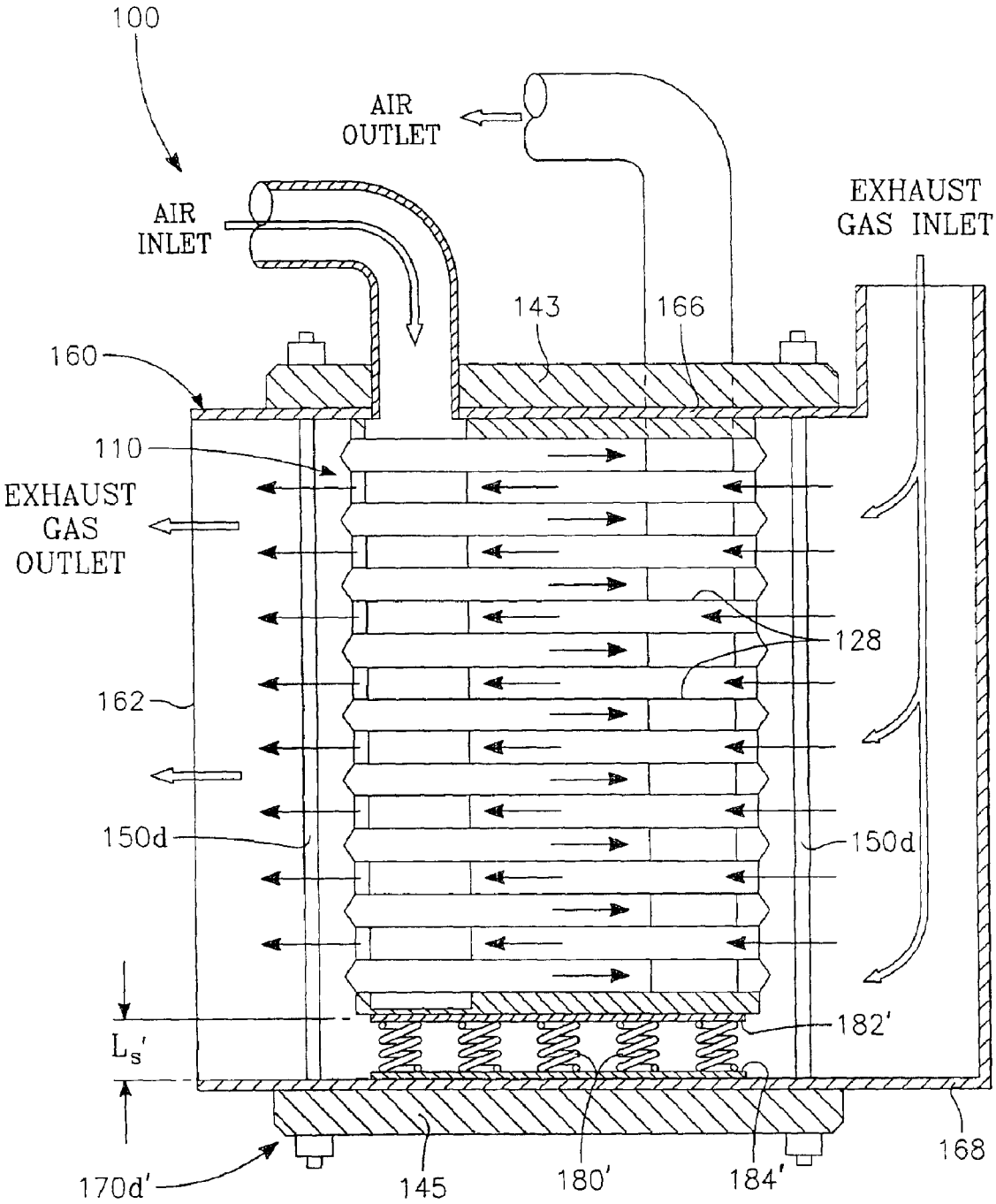

At least one embodiment of the present invention, as shown in FIG. 8*b*, uses more than one compression spring. As shown, several springs 180' can be used in place of the single spring 180 (as shown in FIG. 8*a*). Such an embodiment functions generally in the same manner as the single spring 180. That is, the springs 180' apply a biasing force on to the core 110 to prevent buckling, as shown in FIG. 8*b*. Since the springs 180' can expand and contract, the support structure 170*d'* can also vary its size in response to differential movement of the core 110.

In other embodiments of the applicants invention, the spring 180 or springs 180' are positioned in various other locations. For example, the springs can be positioned between the lower strongback 145 and the lower shell panel 168. Likewise, the springs can be positioned above the core 110, that is between the core 110 and the upper shell panel 166. In still other embodiments of the present invention, the spring 180 or springs 180' have shapes other than the coil shaped shown in FIGS. 8*a* and *b*. In these embodiments the springs are any of a variety of shapes such as leaf, beam, curved or the like. One such embodiment uses a corrugated spring in place of the coil spring 180. The corrugated spring can be made of sheet metal bent repeatedly into a corrugated shape.

In some embodiments of the present invention, tie rods 150*d* are used in conjunction with the bellows 190 and 190', as shown in FIGS. 8*a* and *b*. However, in other embodiments, the tie rods can be positioned between the upper strongback 143 and the lower end of the core 110. These embodiments allow at least some of the loading to not have to be carried by the springs 180 and 180'. This also allows lighter Springs to be used.

Pressurized Bellows Apparatus:

In other embodiments of the present invention the support structure employs a bellows mechanism to mechanically expand and contract while maintaining a compressive force on the core 110. Embodiments of such support structures are shown in FIGS. 9*a* and *b*.

Figure 9A:
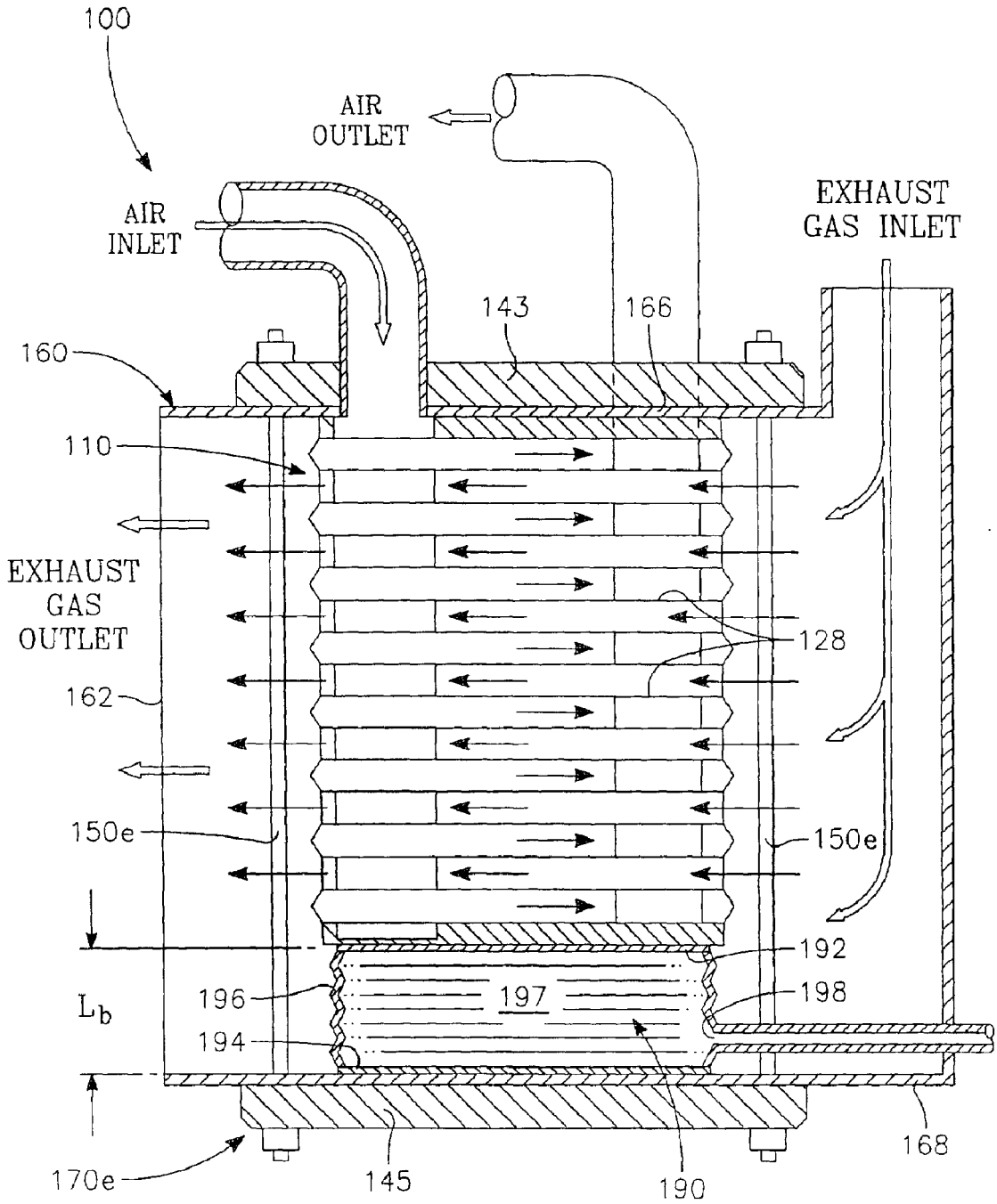
FIGS. 9*a* and *b* are side cut-away views of a portion of a heat exchanger in accordance with the present invention.

As shown in FIGS. 9*a* and *b*, a support structure 170*e* includes the upper strongback 143, the lower strongback 145, tie rods 150*e* (the strong backs and ties rods collectively a fixed member with the strongback 143 at a first end and the strongback 145 at a second end of the fixed member), the shell 160 and a biased deformable member or sealed bellows 190. The bellows 190 is a sealed structure which contains a pressurized gas or other fluid and which can expand or contract as necessary. Preferably pressurized air is used. The bellows 190 is mounted between components of the support structure 170*e* and the core 110. In this position the bellows 190 can apply a force (e.g. pre-load) to the core 110, to hold the core plates 128 together and/or prevent the plates 128 from being unacceptably displaced from their original positions (e.g. such that leaks in the core are created). When the pressure in the bellows 190 is raised, the force applied to the core 110 is likewise increased. The pressure in the bellows 190 is variable to be able to accommodate the requirements of the particular use in which it is employed.

In at least some embodiments, the bellows 190 includes a first bellows plate 192, a second bellows plate 194 and bellows sides 196, as shown in FIGS. 9*a* and *b*. The first bellows plate 192, second bellows plate 194 and bellows sides 196 define a fluid space 197 for containing a pressurized fluid. The first bellows plate 192 is positioned against the lower portion of the core 110 so that a force generated by the bellows 190 is applied over the core 110. The first bellows plate 192 can vary in size and can be larger or smaller than the core 110, or it can be sized to match the core 110 as shown in FIGS. 9*a* and *b*.

The second bellows plate 194 is positioned against the lower shell panel 168. Since the lower panel 168 abuts the lower strongback 145, forces applied to the lower panel 168 by the second plate 194 are carried by the support structure 170*e*.

The bellow sides 196 contain the fluid (e.g. air) in the bellows 190, and in so doing, carry loads generated by the fluid pressure. The sides 196 also function to allow the bellows 190 to expand and contract in a longitudinal direction (e.g. in a direction generally perpendicular to the plates 192 and 194). This expansion can be accommodated by any of variety of different bellows side structures. In some embodiments, as shown in FIGS. 9*a* and *b*, a folding structure is employed for the sides 196. This allows the bellows to freely expand and contract so that any differential expansion of the core 110 can be reacted to by the support structure 170*e*. That is, the folding sides 196 allow the length $L_b$ of the bellows 190 to vary. In this manner, the core 110 will not be damaged by buckling, creep and/or fatigue failures, which might otherwise result from support structure 170*e* not being able to expand and contract with the core 110. As noted in detail below, other configurations for the sides 196 can be used as well.

The fluid (gas, liquid, etc.) used in the bellows 190 is supplied via a port 198 which is connected to a supply source (not shown). The port 198, supply source and the fluid space 197 are in fluid communication with one another. The supply source typically includes a control mechanism (not shown) for regulating flow and pressure of the fluid. Suitable supply sources and control mechanisms are commercially available. Preferably, a gas is used for the fluid in the bellows. In at least one embodiment, the supply source includes a high pressure bled from the turbine (not shown) which the heat exchanger 100 is attached to.

Depending on the specific requirements of the use of the bellows 190, the pressure can be kept at, or near, a constant value or the pressure can be varied. With a constant pressure the bellows 190 will exert a generally constant biasing force against the core 110. Similarly, with variable pressure, the biasing force can be adjusted as necessary to accommodate the operation of the heat exchanger 100. If the amount of fluid in the bellows 190 is kept substantially constant, then the pressure within the bellows 190 will change as the core 110 expands and contracts. In such an embodiment of the invention the biasing force exerted on the core 110 will increase as the core 110 expands, and decrease as it contracts.

With the bellows 190 maintaining constant contact with the core 110, the bellows 190 prevents, or at least greatly limits, any exhaust gas flow from bypassing the core 110. By not allowing the exhaust gas to have an alternate route, all, or least substantially all, of the exhaust gas must pass through the core 110. This maximizes the efficiency of the heat exchanger 100.

The specific configuration of the bellows 190 can vary depending on the requirements of the particular heat exchanger it is used with. That is, the particular size, shape, structure and material of the bellows 190 depend on a variety of factors including the amount of expansion and the force that the bellows 190 is required to provide. The specifics of the configuration of the bellows 190 for the particular use which it is employed can be determined by one skilled in the art of the design of such structures, using well known analytical and/or empirical methods.

The material used to construct the bellows 190 can vary, but it is preferred if the bellows 190 is of a material which will not be damaged or unacceptably degraded when subjected to the typically high temperatures of the exhaust gases passing by the bellows 190. Although a variety of suitable materials, including steel and aluminum, can be used for the bellows 190, it is preferred that stainless steel is employed. Further, a high temperature resistant material such as a tightly woven ceramic cloth with a wire mesh can be used in conjunction with the other suitable materials.

Figure 9B:
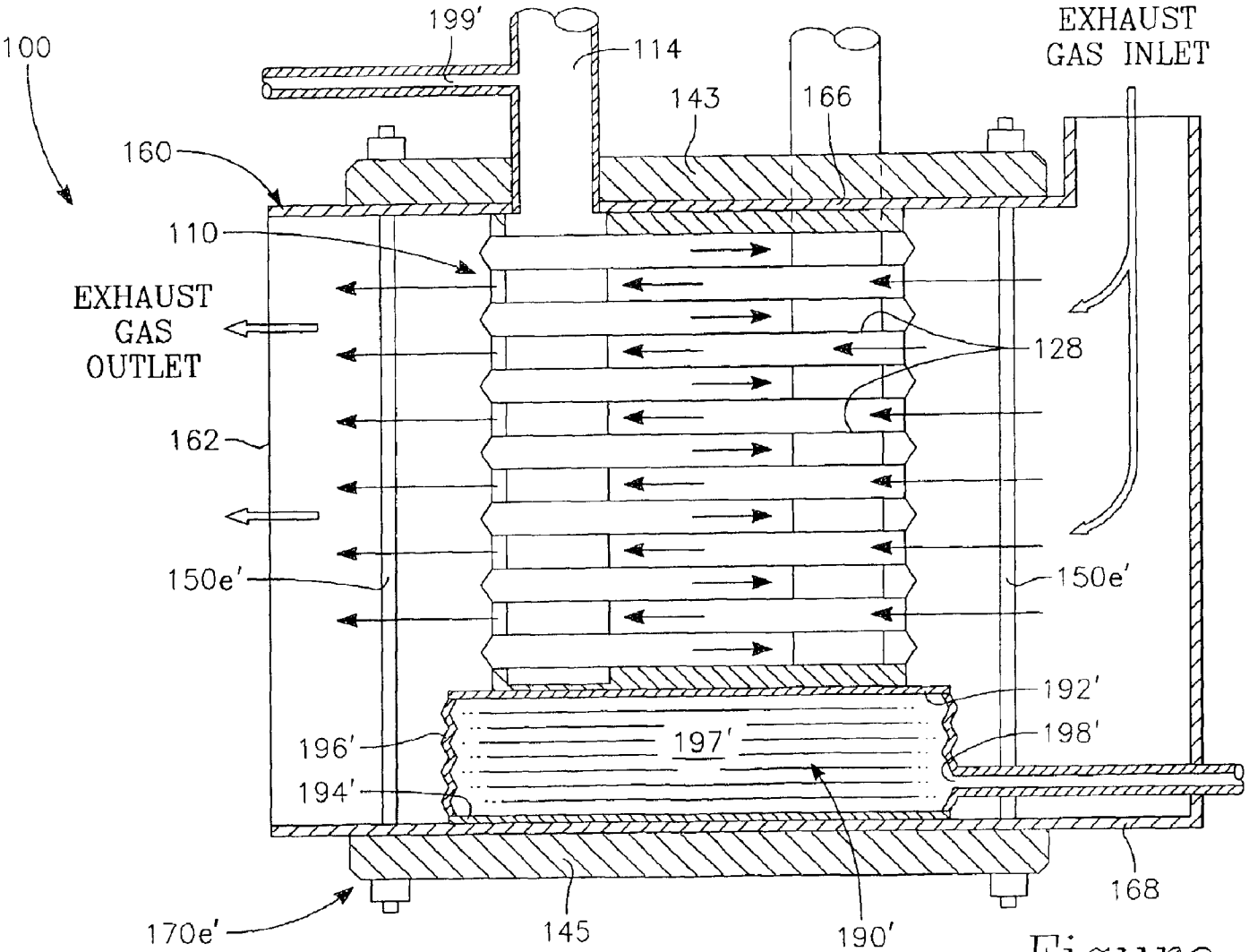

While the width of the bellows can vary, it is preferred that the bellows be wider than the core 110. As shown in FIG. 9*b*, in at least one embodiment of the present invention, a bellows 190' is used which is larger across (wider) than the core 110. In this manner the first bellows plate 192' of the bellows 190' provides a larger area for the pressure in the bellows 190' to act upon. As such, the total amount of force applied to the core 110 by the bellows 190' is increased as compared to a narrower bellows 190 (as shown in FIG. 9*a*). This embodiment also provides the benefit that the same force can be created with a lower fluid pressure. A lower fluid pressure in turn allows for a thinner and lighter structure for the bellows 190'.

The bellows 190' includes the first bellows plate 192', a second bellows plate 194', bellows sides 196' and a port 198'. Preferably, the port 198' is supplied air by a connected air supply port 199' (connection not shown). As shown in FIG. 9*b*, the port 199' is tapped into the air inlet 114 of the core 110. With the port 198' in communication with the air inlet via the port 199', the core 110 and the bellows 190' have the same air pressure. However, because the bellows 190' is wider than the core 110, the air pressure in the bellows 190' acts over a larger surface area than that of the core 110. This results in a greater force being exerted by the bellows 190' on to the core 110 than the force which is exerted by the core 110 on the bellows 190'. As such, by having the bellows 190' pressurized by being connected to the air inlet 114, a net compression force is applied by the bellows 190' to the core 110, preventing the core 110 from buckling or otherwise being displaced.

The bellows 190' is part of the support structure 170*e*'. The support structure 170*e*' includes tie rods 150*e*', strong backs 143 and 145 and the bellows 190'.

Other embodiments of the present invention include using more than one bellows, in parallel (adjacent each other) or series (end-to-end). Also, the bellows 190 and/or 190' are positioning in other locations than those shown in FIGS. 8*a* and *b* and 9*a* and *b*. For example, the bellows 190 can be positioned in between the lower strongback 145 and the lower shell panel 168 or above the core 110 on either side of the upper shell panel 166.

In some embodiments of the present invention, tie rods 150*e* and 150*e*' are used in conjunction with the bellows 190 and 190', respectfully, as shown in FIGS. 9*a* and *b*. However, in other embodiments, the tie rods can be positioned between the upper strongback 143 and the lower end of the core 110. These embodiments allow at least some of the loading to not have to be carried by the bellows. This also allows the pressure in the bellows to be lowered without the core 110 excessively expanding.

Figure 10A:
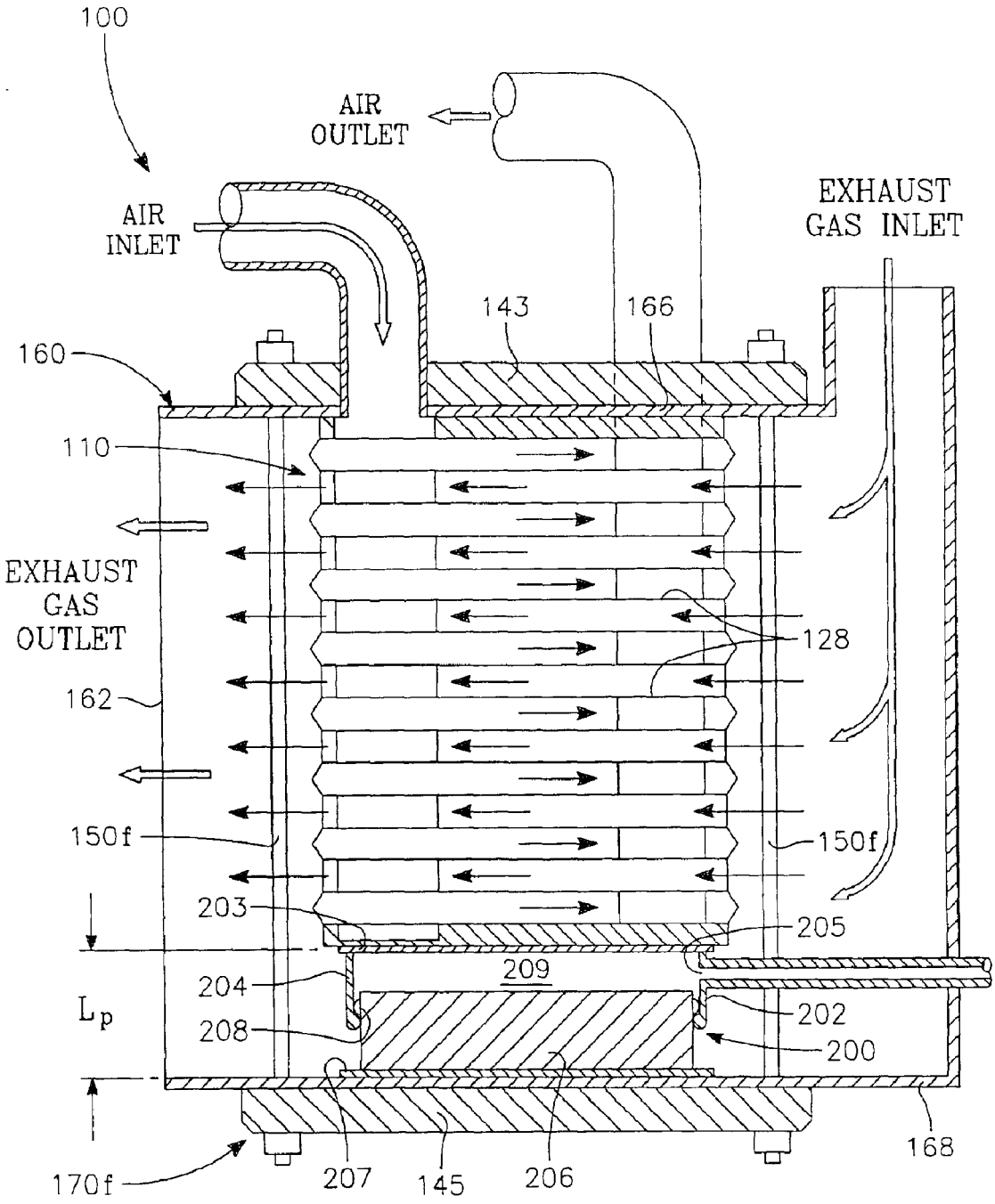
FIGS. 10*a* and *b* are side cut-away views of a portion of a heat exchanger in accordance with the present invention.

Pressurized Piston Apparatus:

Other embodiments of the present invention allow for differential expansion and contraction, as well as application of a biasing force to the core 110, by the use of a biased deformable member or pressurized piston assembly 200. One such embodiment is a piston assembly 200 as shown in FIG. 10*a*. As can be seen, the piston assembly 200 is part of a support structure 170*f* and is positioned between the core 110 and the other components of the support structure 170*f*. The support structure 170*f* includes strongback 143, strongback 145, tie rods 150*f* (the strong backs and ties rods collectively a fixed member with the strongback 143 at a first end and the strongback 145 at a second end of the fixed member) and the shell 160.

The piston assembly 200 contains a fluid (a gas or a liquid) which is under pressure. Preferably pressurized air is used. The piston assembly 200 functions in a similar manner to that of the bellows 190 (not shown). The pressure causes the piston assembly 200 to exert a force onto the core 110. This force is a biasing force which pre-loads the core 110. Also, the length $L_p$ of the piston 200 can be varied to allow for differential expansion between the core 110 and the support structure 170*f*.

The piston assembly 200 includes a cylinder 202 and a piston 206. The cylinder 202 and piston 206 define a fluid space 209 for containing a pressurized fluid. The cylinder 202 in turn includes a first piston plate 203, sides 204 and an fluid port 205. The piston 206 includes a second piston plate 207 and a seal 208.

As shown in FIG. 10*a*, the cylinder 202 abuts the core 110 at the first plate 203, which allows the force generated by the piston assembly 200 to be applied to the core 110. The cylinder 202 is sized and shaped to receive the piston 206, preferably it is round to receive a cylindrical shaped piston. The piston 206 is held in the cylinder 202 by the cylinder sides 204. The fluid port 205 allows the pressurized fluid to enter and leave the fluid space 209. The fluid port 205 is attached to a fluid source (not shown) which supplies the pressurized fluid. In some embodiments this source is a high pressure bled from the turbine (not shown) attached to the heat exchanger 100. The fluid port can include a valve (not shown) to control the flow of the fluid.

The piston 206 can slide along the inside of the sides 204 of the cylinder 202. In this manner the overall length $L_p$ of the piston assembly 200 can be varied, allowing for the differential expansion and contraction of the core 110 relative to the support structure 170*f*. FIG. 10*a* shows the second mounting surface 207 of the piston 206 abutting the lower shell panel 168 of the shell 160. The piston 206 can also include the seal 208 to prevent fluid from escaping from the fluid space 209. It is preferred that the piston is cylindrical in shape.

As with the bellows 190 (not shown in FIG. 10*a*), the specific size and shape of the piston assembly 200 is dependent on the specific needs of the use and the available fluid pressure. The particular size, shape and extension of the piston assembly 200 to meet the needs of the use, can be determined by one skilled in the design of such structures using well known analytical and/or empirical methods.

The material used to construct the piston assembly 200 can vary, but it is preferred if the piston assembly 200 is of a material which will not be damaged or unacceptably degraded when subjected to the typically high temperatures of the exhaust gases passing through the shell 160 and adjacent the piston assembly 200. Although a variety of suitable materials, including steel and aluminum, can be used for the piston assembly 200, it is preferred that a stainless steel is employed. Further, a high temperature resistant material such as a tightly woven ceramic cloth with a wire mesh can be used in conjunction with the other suitable materials.

Figure 10B:
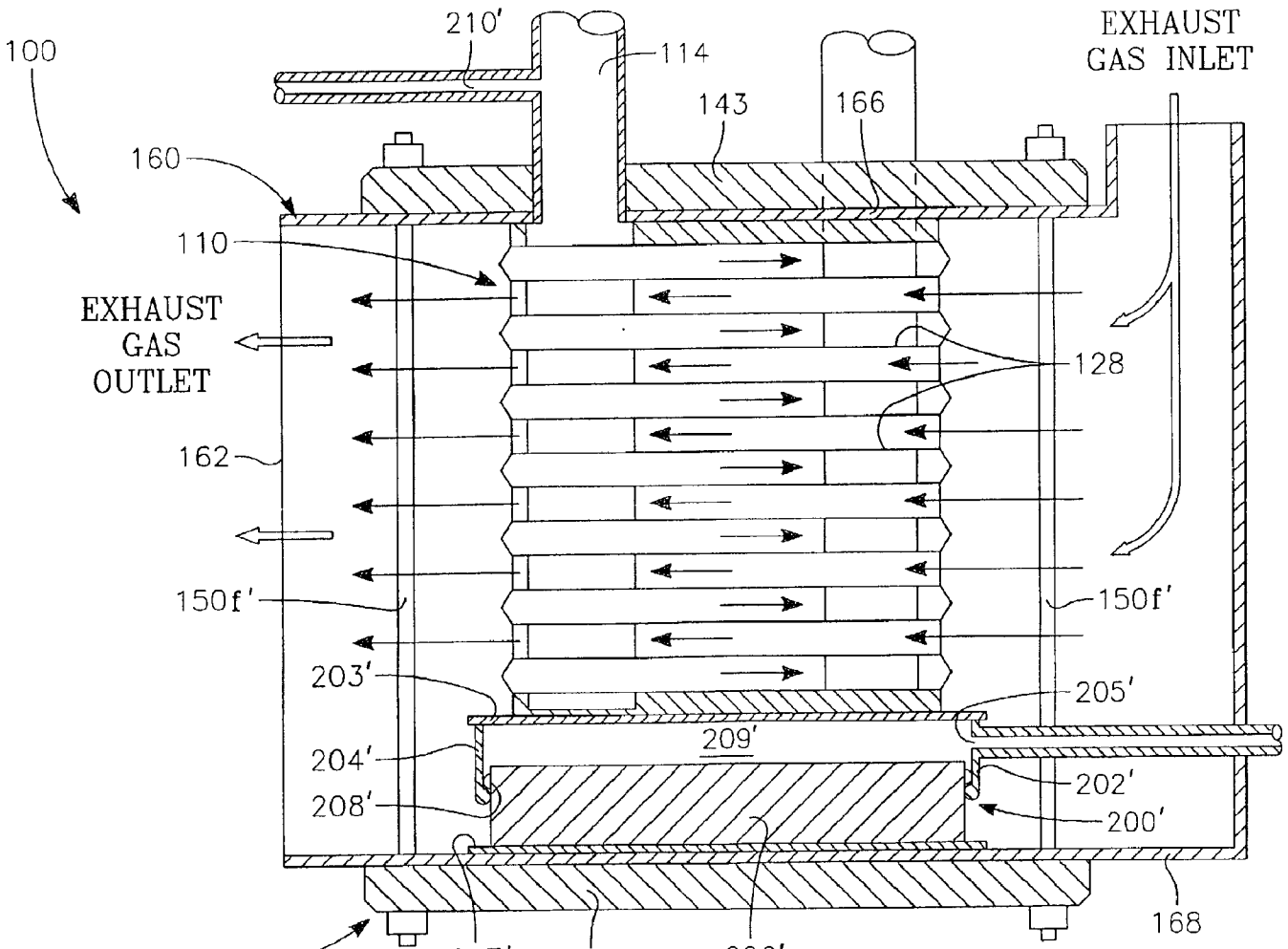

In some embodiments of the present invention, a piston assembly 200' which is wider than the core 110 is used. One such embodiment is shown in FIG. 10*b*. As with the similar embodiment of the bellows 190' (not shown), the wider piston assembly 200' provides increased forces for given fluid pressures, as compared to the narrower piston assembly 200 (as shown FIG. 10*a*). This is because the fluid pressure is applied over an increased surface area. For the same exerted force, the wider piston 200', operates with lower fluid pressure and as such can be thinner and lighter in its constriction as compared with the piston assembly 200.

The piston assembly 200' includes a cylinder 202' and a piston 206'. The cylinder 202' and piston 206' define a fluid space 209' for containing a pressurized fluid. The cylinder 202' in turn includes a first piston plate 203', sides 204' and an fluid port 205'. The piston 206' includes a second piston plate 207' and a seal 208'.

In some embodiments, the port 205' is supplied air by a connected air supply port 210' (connection not shown). As shown in FIG. 10*b*, the port 210' is tapped into the air inlet 114 of the core 110. With the port 205' in communication with the air inlet via the port 210', the core 110 and the piston 200' have the same air pressure. However, because the piston 200' is wider than the core 110, the air pressure in the piston 200' acts over a larger surface area than that of the core 110. This results in a greater force being exerted by the piston 200' on to the core 10 than the force which is exerted by the core 110 on the piston 200'. As such, by having the piston 200' pressurized by being connected to the air inlet 114, a net compression force is applied by the piston 200' to the core 110, preventing the core 110 from buckling or otherwise being displaced.

The piston 200' is part of the support structure 170*f*'. The support structure 170*f*' includes tie rods 150*f*', strong backs 143 and 145 and the piston 200'.

Many alternative embodiments of the piston assembly 200 exist. For example, in at least one embodiment the piston 206 is positioned against the core 110 and the cylinder 202 abuts the shell 160. In another embodiment, the fluid port 205 is positioned in the piston 206. Also, more than one fluid port can be used. In other embodiments of the present invention more than one piston assembly is used. In some embodiments of the present invention, tie rods 150*f* and 150*f*' are used in conjunction with the pistons 200 and 200', respectfully, as shown in FIGS. 10*a* and *b*. However, in other embodiments, the tie rods can be positioned to attached between the upper strongback 143 and the lower end of the core 110. These embodiments allow the pistons to carry less loads than they would otherwise carry.

While the preferred embodiments of the present invention have been described in detail above, many changes to these embodiments may be made without departing from the true scope and teachings of the present invention. The present invention, therefore, is limited only as claimed below and the equivalents thereof.

What is claimed is:

1. A heat exchanger comprising:

a. a core having a variable length and comprising a stack of plates to facilitate heat exchange; and b. a support structure, wherein the core is received by the support structure, wherein the support structure comprises a fixed member and an attached fluid-biased bellows for accommodating variations in the length of the core while applying a biasing force to the core, wherein the fixed member comprises a first end and a second end, wherein the first end and the second end are positioned about the core, wherein the first end is in contact with the core, wherein the bellows is mounted between the core and the second end of the fixed member, so that the bellows is deformed as the length of the core varies and wherein the bellows is wider than the core.

2. The heat exchanger of claim 1, wherein the core is pressurized with a gas and wherein the bellows is in fluid communication with the core, so that the bellows has substantially the same gas pressure as the core.

3. A heat exchanger comprising:

a. a core having a variable length; and b. a support structure, wherein the core is received by the support structure, wherein the support structure comprises a fixed member and an attached bellows for accommodating variations in the length of the core while applying a biasing force to the core, wherein the bellows is wider than the core, wherein the fixed member comprises a first end and a second end, wherein the first end and the second end are positioned about the core, wherein the first end is in contact with the core, wherein the bellows is mounted between the core and the second end of the fixed member, so that the bellows is deformed as the length of the core varies and wherein the core is pressurized with a gas and wherein the bellows is in fluid communication with the core, so that the bellows has substantially the same gas pressure as the core.

* * * * *